US010130986B1

(12) United States Patent
Huang

(10) Patent No.: US 10,130,986 B1
(45) Date of Patent: Nov. 20, 2018

(54) TUBE FLARING TOOL

(71) Applicant: YUNG CHI INDUSTRY CO., LTD., Taichung (TW)

(72) Inventor: Wu-Sheng Huang, Taichung (TW)

(73) Assignee: Yung Chi Industry Co., Ltd., Taichung (TW)

( * ) Notice: Subject to any disclaimer, the term of this patent is extended or adjusted under 35 U.S.C. 154(b) by 0 days.

(21) Appl. No.: 15/641,981

(22) Filed: Jul. 5, 2017

(51) Int. Cl.
*B21D 41/02* (2006.01)
*B21D 37/12* (2006.01)

(52) U.S. Cl.
CPC ..... *B21D 41/021* (2013.01); *B21D 37/12* (2013.01)

(58) Field of Classification Search
CPC ..... B21D 41/02; B21D 41/021; B21D 37/12; B21D 19/00
USPC ..... 72/317, 370.11, 370.1
See application file for complete search history.

(56) References Cited

U.S. PATENT DOCUMENTS 7,353,682 B2 * 4/2008 Buchanan ..... B21D 41/021 72/317
2011/0247387 A1 * 10/2011 Buchanan ..... B21D 41/021 72/317

* cited by examiner

*Primary Examiner* — Teresa M Ekiert
(74) *Attorney, Agent, or Firm* — Wang Law Firm, Inc.

(57) ABSTRACT

A tube flaring tool, which is adapted to clamp a tube and align the tube with a punch driver, includes a carrier having a clamping assembly slot and a punch assembly slot; a clamping assembly received in the clamping assembly slot of the carrier to clamp a tube; and a punch assembly having a main member and a plurality of punches movably coupled to the main member. The main member is movably received in the punch assembly slot, so that the main member of the punch assembly is able to be moved to select one of the punches to flare the tube.

14 Claims, 13 Drawing Sheets

TUBE FLARING TOOL

BACKGROUND OF THE INVENTION

1. Technical Field

The present invention relates to a hand tool, and more particularly to a tube flaring tool.

2. Description of Related Art

In order to connect a metal tube to a machine or another tube, the tube has to be flared by a flaring tool. A conventional flaring tool has a clamping member to secure a tube and a punch squeezed into the tube to flare it.

Typically, there is a specified length of the tube being left out of the clamping member according to the shape and size of the tube to be flared when the tube is secured by the clamping member. Therefore, it usually needs two punches to flare the tube. In other words, a smaller punch is applied for a preliminary flaring before the second punch flares the tube to the final shape and size. It is inconvenient to the user.

The flaring tool usually is equipped with a positing member to keep the tube with specified length left out of the clamping member. Therefore, user has to operate the positing member before applying the punch to flare the tube. It is inconvenient to the user as well.

BRIEF SUMMARY OF THE INVENTION

In view of the above, the primary objective of the present invention is to provide a tube flaring tool, which provides a switchable punch to flare a tube.

The present invention provides a carrier and a movable punch assembly, which is moved in a straight path or a curved path, or to be rotated, to align one of the punches of the punch assembly with a tube and a flaring driver for a flaring operation. Besides, the punch assembly is moved to a predetermined position to determine and restrict a suitable length of the tube to be flared.

In order to achieve the objective of the present invention, a tube flaring tool, which is adapted to clamp a tube and align the tube with a punch driver, includes a carrier having a clamping assembly slot and a punch assembly slot; a clamping assembly received in the clamping assembly slot of the carrier to clamp a tube; a punch assembly having a main member and a plurality of punches movably coupled to the main member, wherein the main member is movably received in the punch assembly slot. The main member of the punch assembly is moved to align the punches with the tube and the punch driver respectively.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
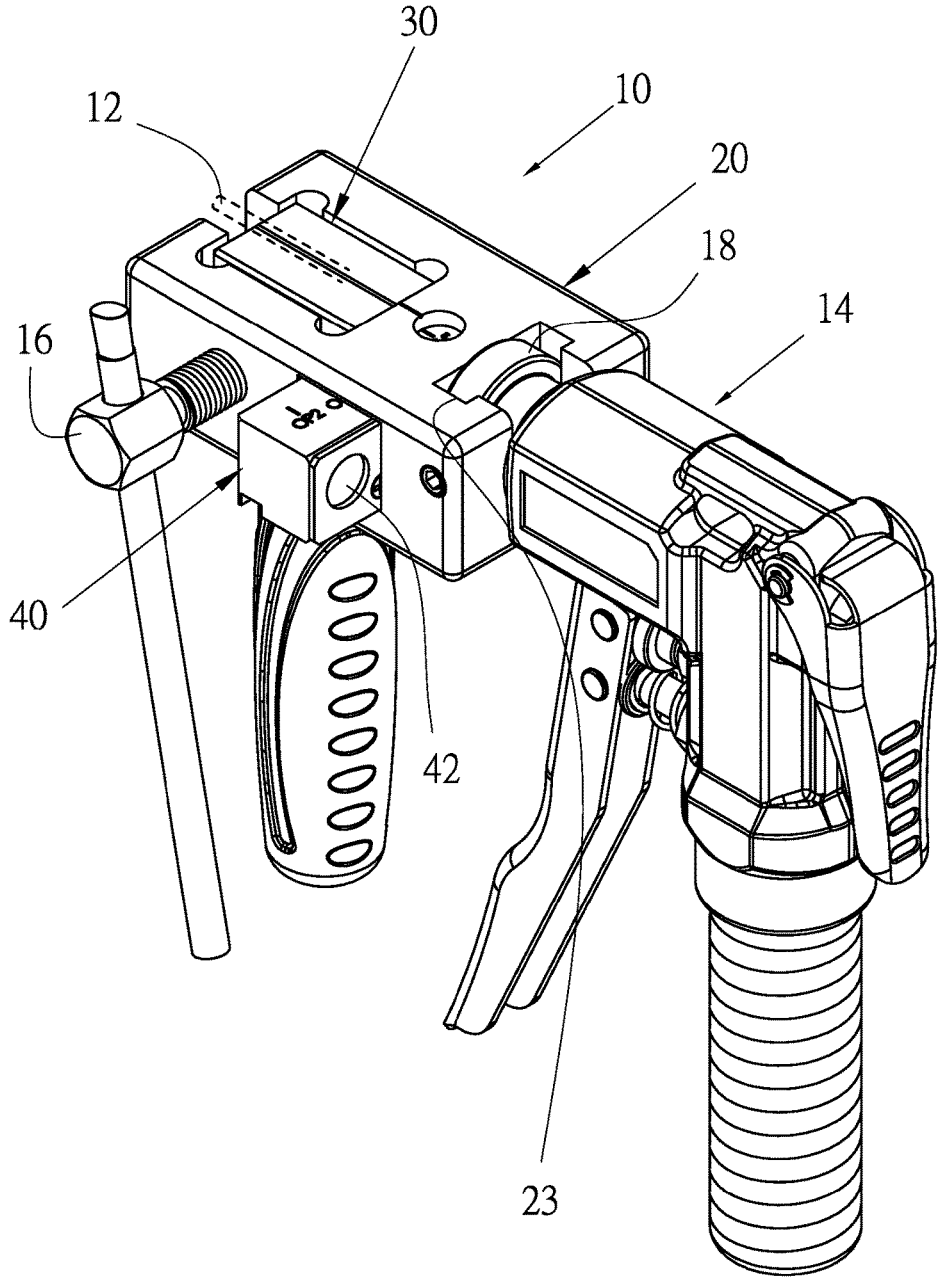
FIG. 1 is a perspective view of a first preferred embodiment of the present invention.
Figure 2:
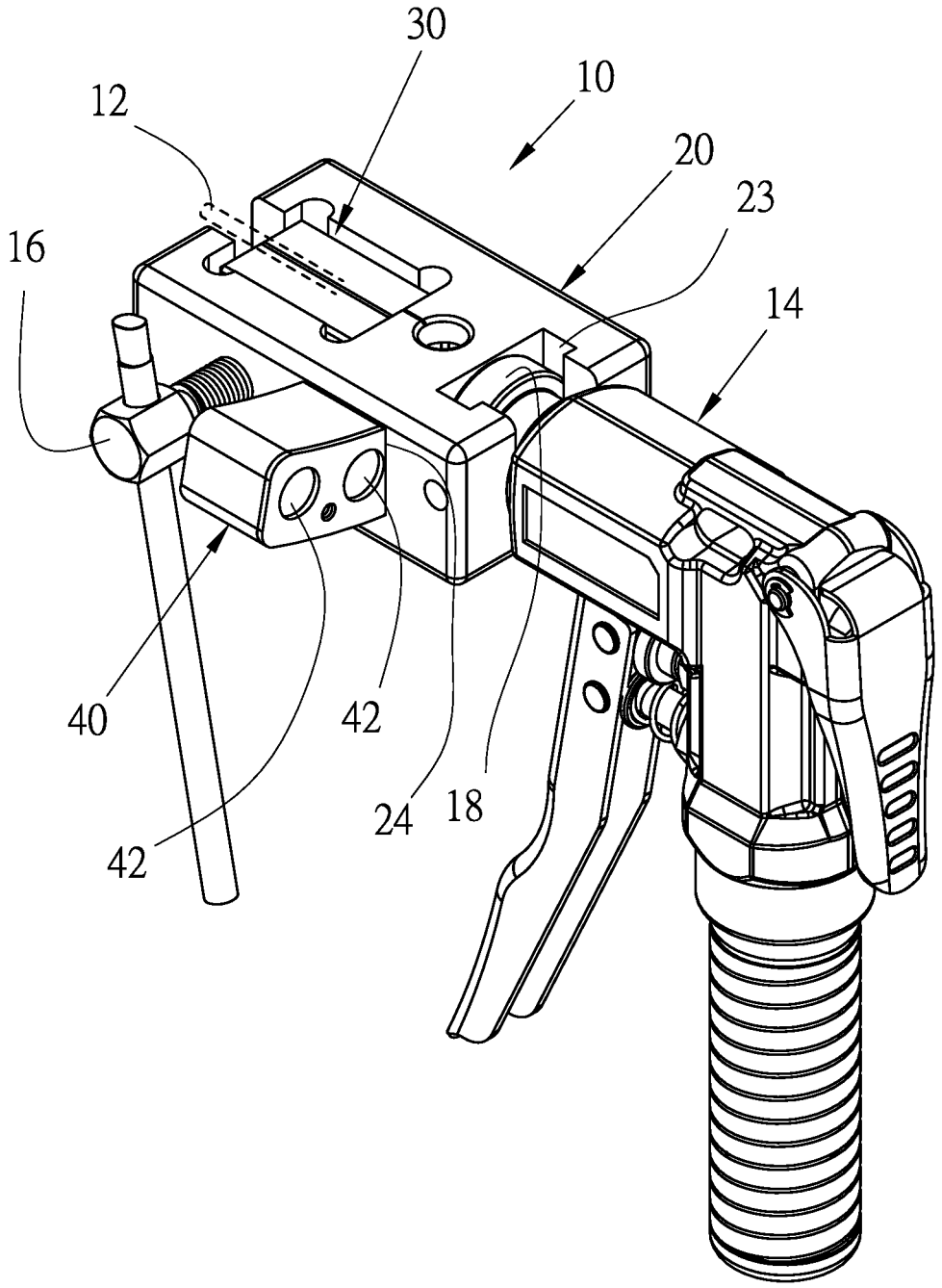
FIG. 2 is a perspective view of a second preferred embodiment of the present invention.
Figure 3:
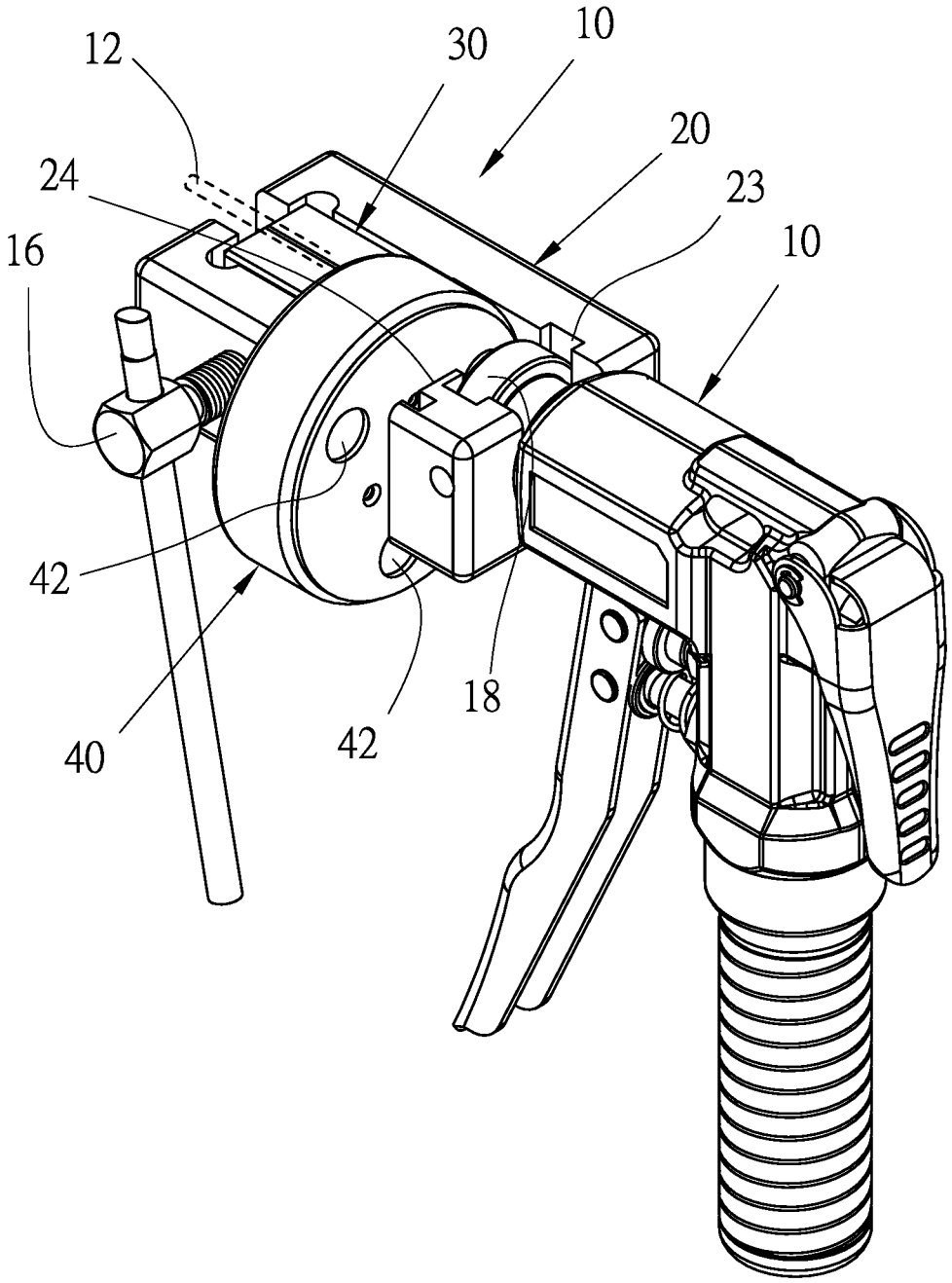
FIG. 3 is a perspective view of a third preferred embodiment of the present invention.

As shown in FIGS. 1, 2 and 3, a tube flaring tool 10 of the first preferred embodiment of the present invention is applied to hold a tube 12 and connect to a punch driver 14. The tube flaring tool 10 includes a clamping assembly 30 and a punch assembly 40, both of which are mounted on a carrier 20. The carrier 20 connects to the punch driver 14, and the clamping assembly 30 is applied to hold the tube 12.

A pressing assembly 16 is connected to the carrier 20 on a side opposite to the clamping assembly 30. An end of the pressing assembly 16 abuts against the clamping assembly 30 to make the clamping assembly 30 firmly hold the tube 12.

The punch driver 12 includes a block 18 on an end thereof to engage a rotary slot 23 of the carrier 20. The punch driver 12 may be a hydraulic device, a pneumatic device, or a screw device, which has an output member (not shown) connected to the block 18 to move a punch 42.

The punch assembly 40 is driven to change a position or an angle of the carrier 20, so that one of punches 42 of the punch assembly may be moved to be aligned with an end of the tube 12 and the punch driver 14, and the punch driver 14 may drive the punch 42 to flare the tube 12 with a specified shape and size.

Figure 4:
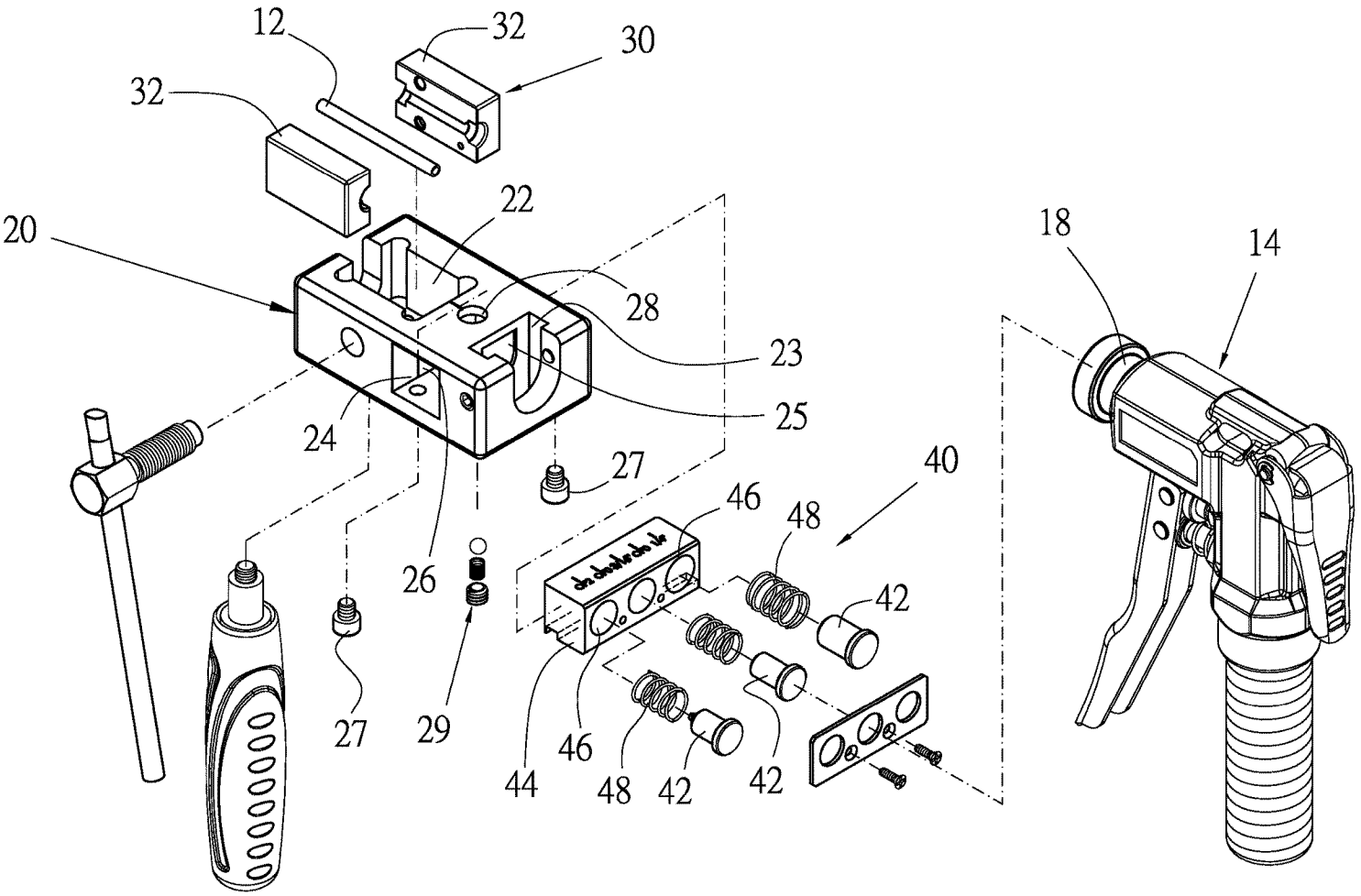
FIG. 4 is a sectional view of the first preferred embodiment of the present invention.
Figure 5:
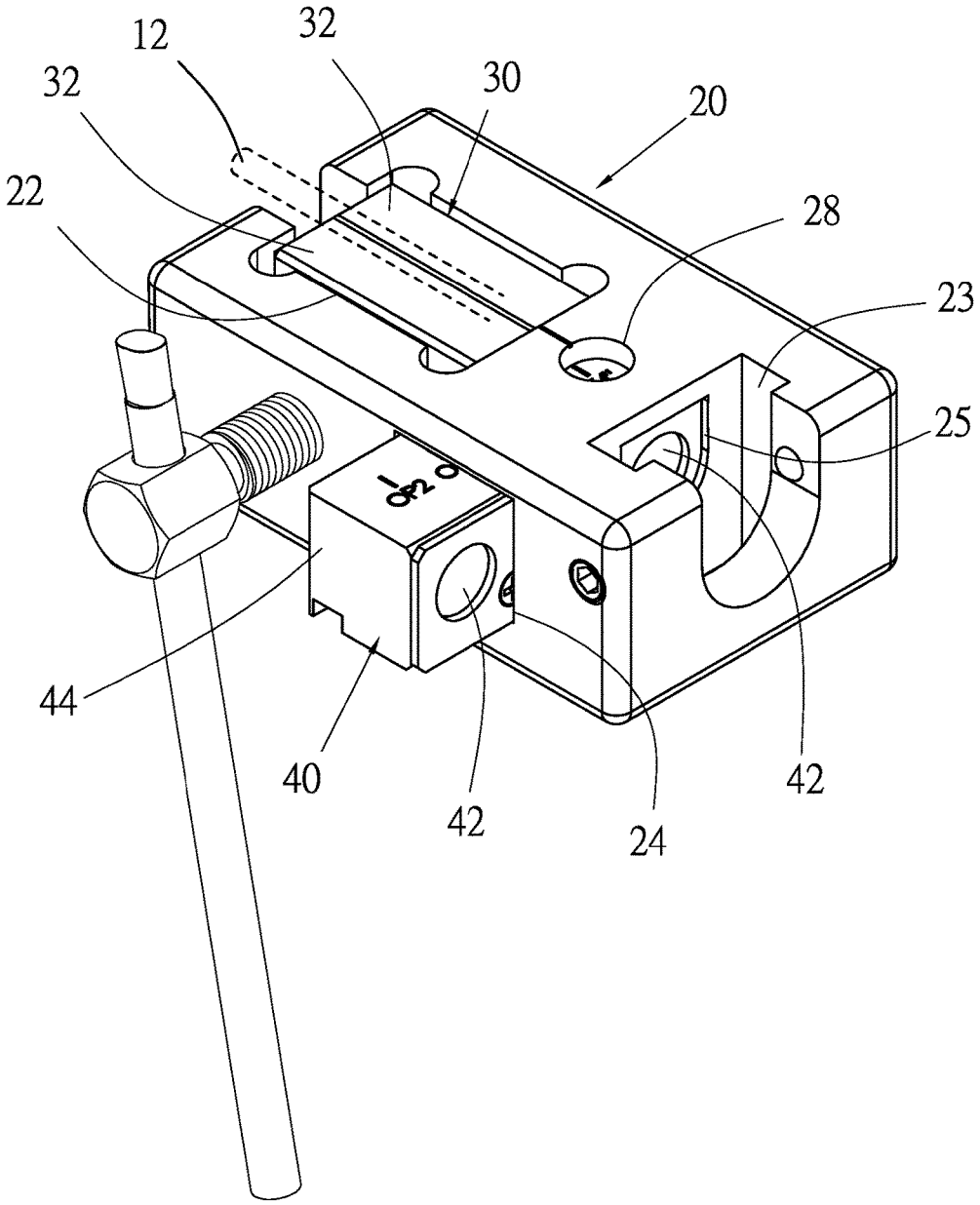
FIG. 5 is a perspective view of the carrier, the clamping assembly, and the punch assembly of the first preferred embodiment of the present invention.

As shown in FIGS. 4 and 5, the carrier 20 of the first preferred embodiment includes a clamping assembly slot 22, a punch assembly slot 24, and a channel 26 connecting the clamping assembly slot 22 to the punch assembly slot 24.

The carrier 20 has a window 28 through the carrier 20. The rotary slot 23 is on a side adjacent to the punch assembly slot 24, and connects to the punch assembly slot 24 through a bore 25.

The clamping assembly 30 includes two clamping members 32 to clamp the tube 12. The clamping members 32 are received in the clamping assembly slot 22 of the carrier 20.

Figure 6:
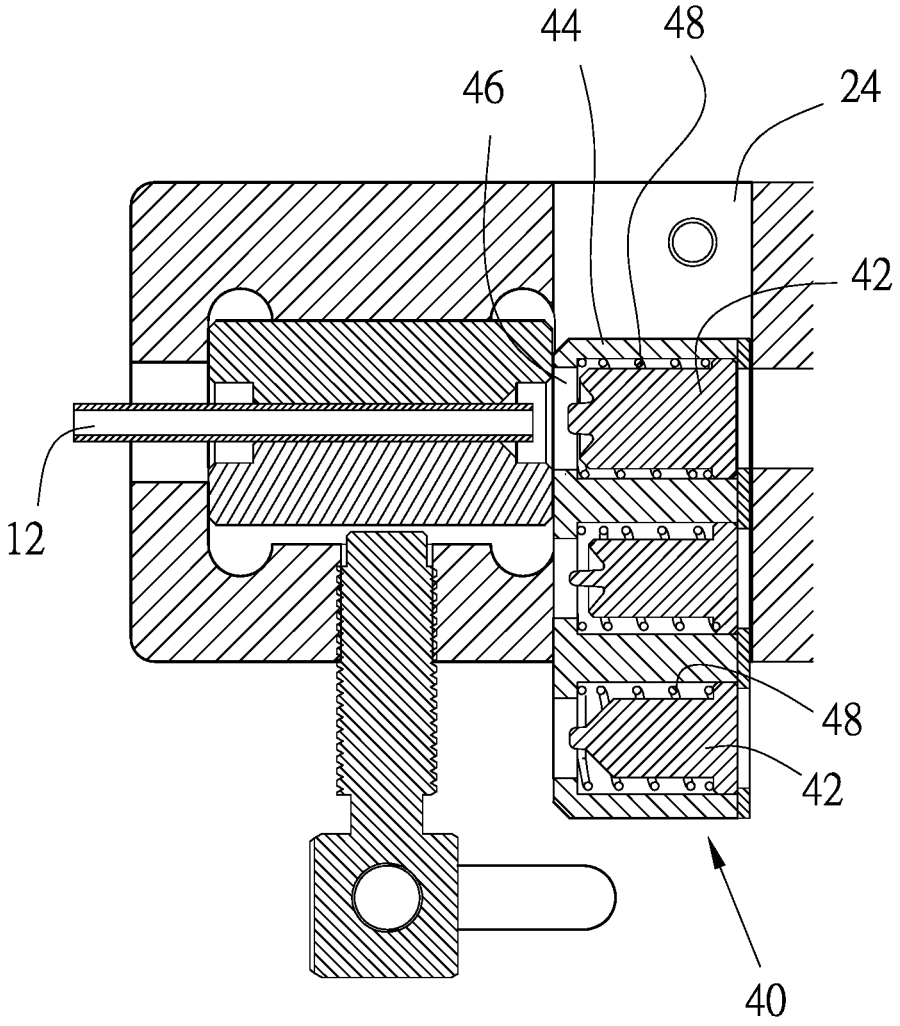
FIG. 6 is a sectional view of FIG. 5.
Figure 7:
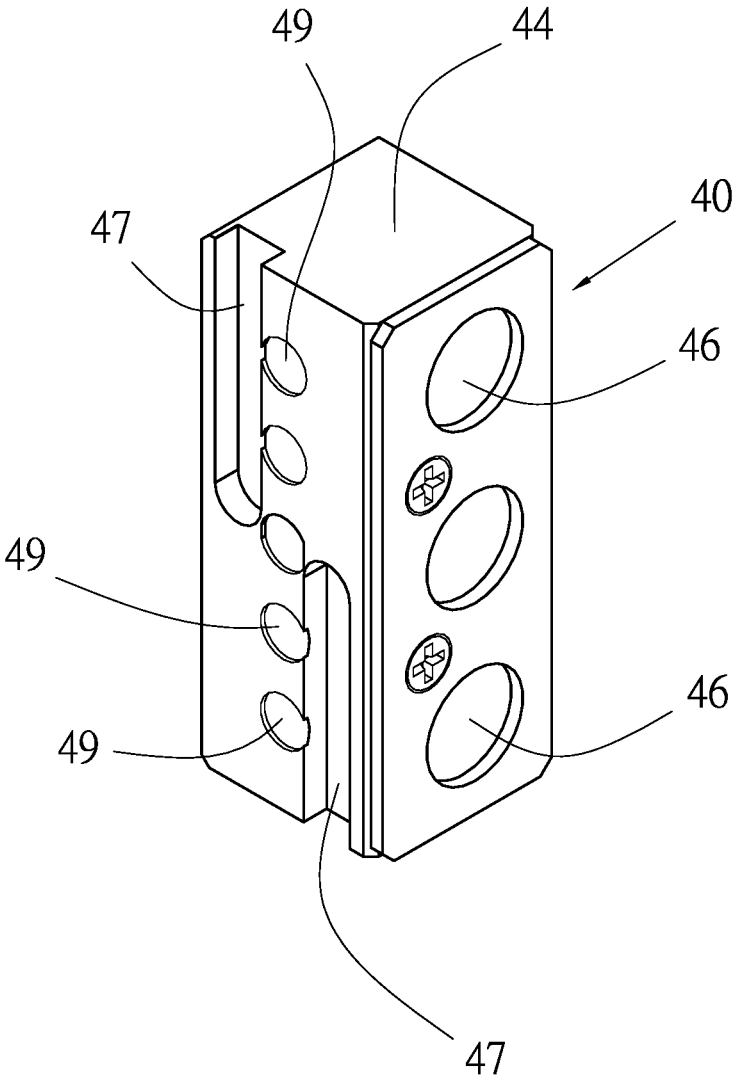
FIG. 7 is a perspective view of the main member of the punch assembly of the first preferred embodiment of the present invention.

As shown in FIGS. 4 and 6, the punch assembly 40 has a main member 44, in which a plurality of punches 42 with different sizes and shapes are provided. The main member 44 has a plurality of punch bores 46, in each of which a spring 48 is received. The punches 42 are received in the punch bores 46 and urged by the springs 48 respectively. The springs 48 urge the punches 42 inwards, so that the entire punches 42 are received in the punch bores 46 normally.

The punch assembly 40 is movably mounted in the punch assembly slot 24 of the carrier 20. Operating ends of the punches 42 face the tube 12. The punch assembly 40 is under the window 28, therefore a portion of the main member 44 is exposed through the window 28 (referring to FIG. 5).

In an embodiment, the main member 44 is engraved or printed with characters, icons or labels above the punch bores 46 respectively to indicate models (size or shape) of the punches 42 in the punch bores 46. Therefore, user may read the model of the punch 20 ready to operate through the window 20.

As shown in FIG. 5, the main member 44 of the punch assembly 40 is provided with two limiting slots 47 on a side and a plurality of positioning bores 49 on a side other than the side with the limiting slots 47.

Figure 8:
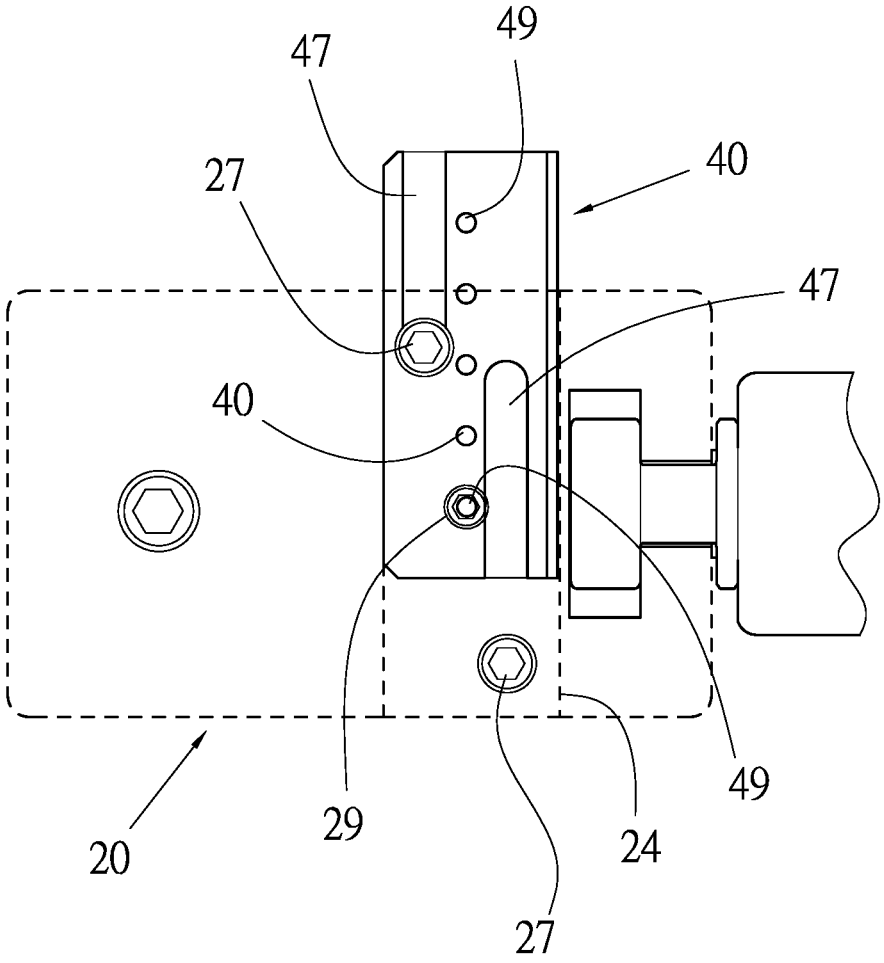
FIG. 8 and FIG. 9 are front views of the main member of the punch assembly of the preferred embodiment of the present invention, showing the main member moving relative to the carrier.

As shown in FIGS. 4 and 8, the carrier 20 is provided with two limiting members 27 and an elastic positioning member 29 on a side thereof. In the present embodiment, the limiting members 27 are bolts, and the elastic positioning member 29 has a ball, a spring, and a screw. However, the limiting members 27 and the elastic positioning member 29 should not be limited to the disclosure of the specification and drawings.

Figure 9:
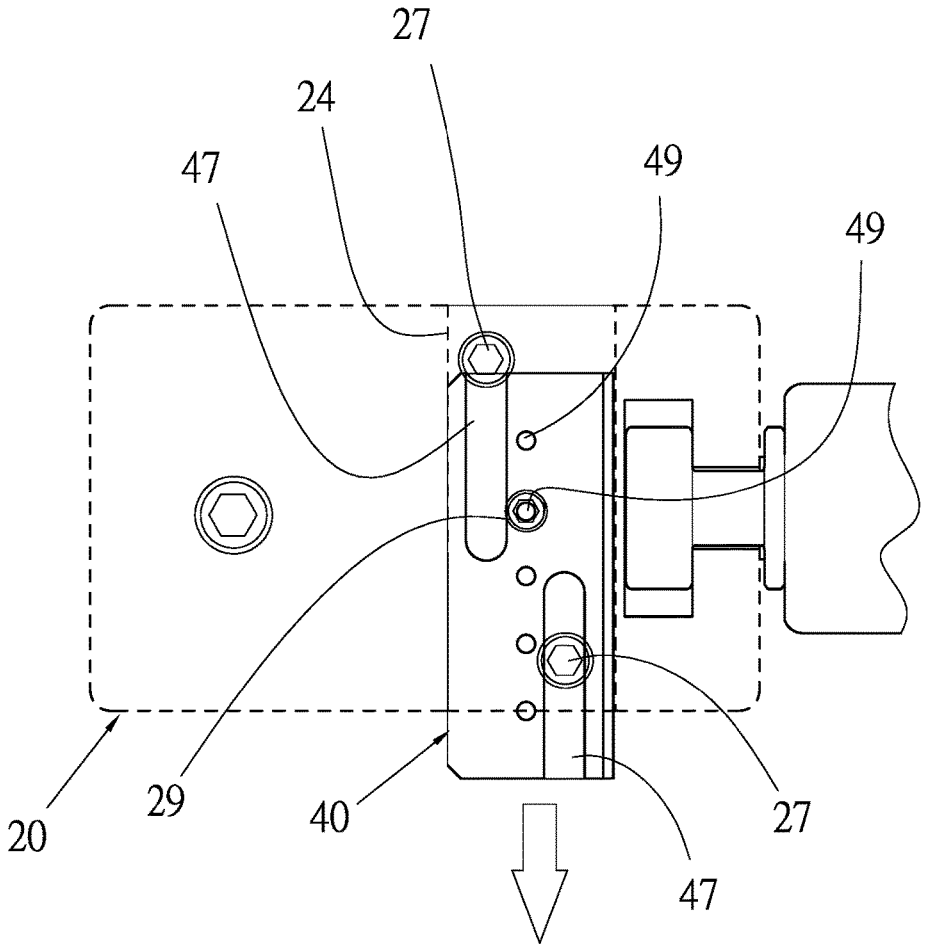

As shown in FIGS. 8 and 9, the punch assembly 40 is movably mounted in the punch assembly slot 24 of the carrier 20 while the limiting members 27 are on a bottom side of the carrier 20 to engage the limiting slots 47 of the main member 44 of the punch assembly 40, so that the punch assembly 40 is able to reciprocate relative to the carrier 20 in a limited range, and unable to leave the carrier 20. The elastic positioning member 29 is on the bottom side of the carrier 20 as well. The ball of the elastic positioning member 29 is able to engage any one of the positioning bores 49 to temporally hold the punch assembly 40.

Figure 10:
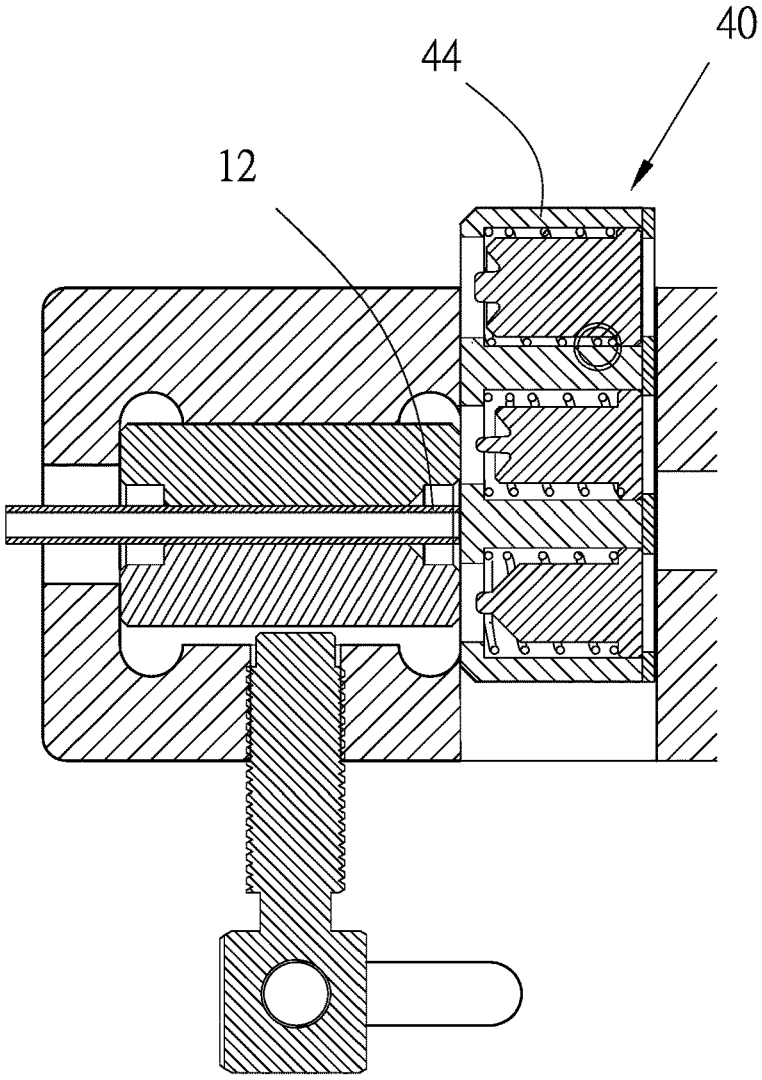
FIG. 10 is a sectional view of the first preferred embodiment of the present invention, showing how the punch assembly stops the tube.

As shown in FIG. 10, the main member 44 of the punch assembly 40 is moved and temporally held by engagement of the elastic positioning member and the positioning bores 49 to have a portion of a surface of the main member 44 between two of the punch bores 46 facing the tube 12, and then the tube 12 is pushed against the surface of the main member 44 that could make sure that the tube 12 have a constant length to be flared.

Figure 11:
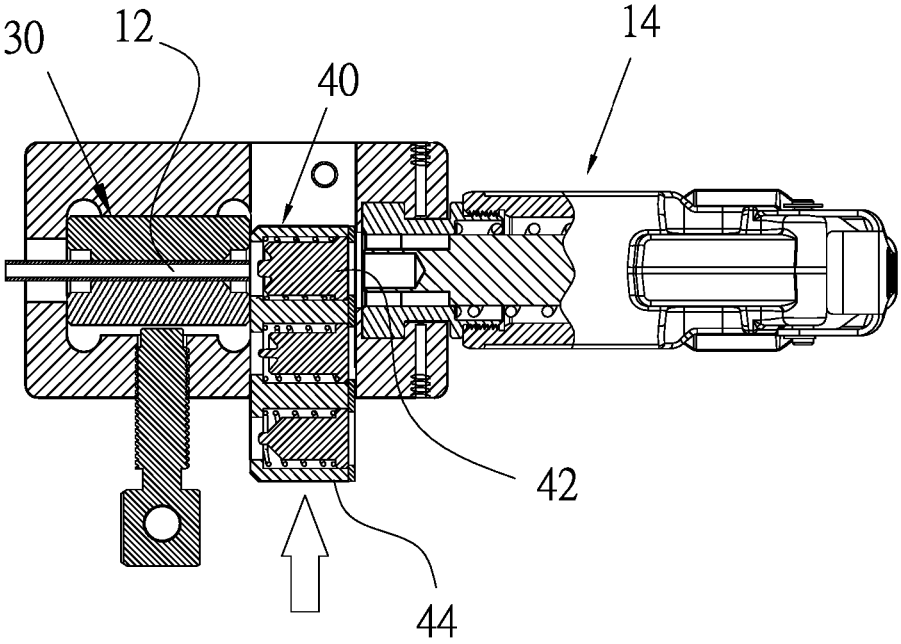
FIG. 11 is a sectional view of the first preferred embodiment of the present invention, showing how the punch assembly moving.

As shown in FIG. 11, after the tube 12 is ready, the main member 44 of the punch assembly 40 is moved again to have a desired punch 42 be aligned with the tube 12 and the punch driver 14. At this time, user may read the model of the punch 42 through the window 28, and then operate the punch driver 14 to move the punch 42 in the punch bore 46 toward the tube 12 to flare the tube 12.

User may select the very punch 42 to flare the tube 12 by moving the main member 44 of the punch assembly 40 instead of replacing the punch, so that the flaring task may be operated in an easy and quick way.

Figure 12:
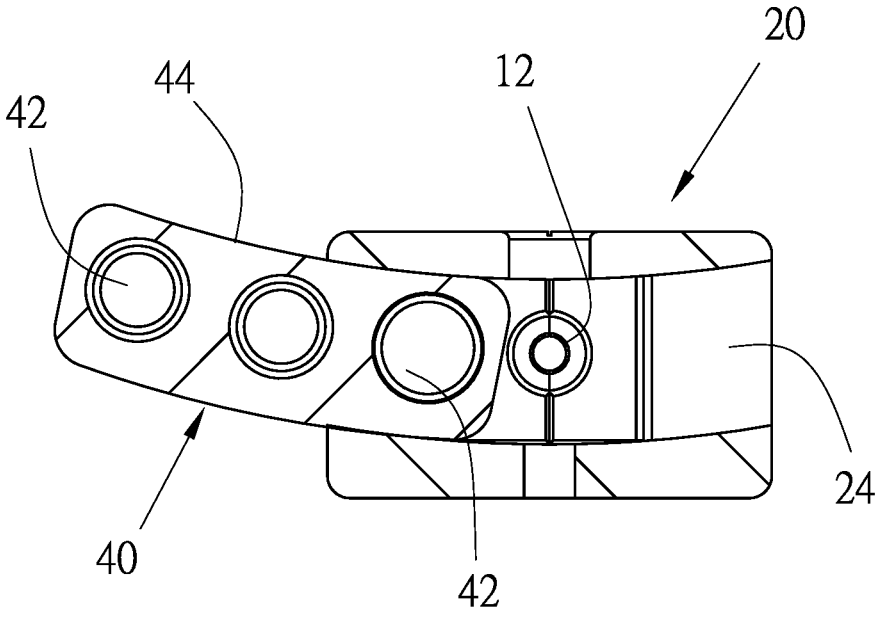
FIG. 12 is a sectional view of the punch assembly and the carrier of the second preferred embodiment of the present invention.

As shown in FIG. 2 and FIG. 12, a tube flaring tool of the second preferred embodiment of the present invention, which is similar to the first preferred embodiment, except that a main member 44 of a punch assemble 40 is an elongated curved member, and a punch assembly slot 24 is curved accordingly. Therefore, the main member 44 is moved in a curved path to select one of the punches 44 to flare the tube 12.

Figure 13:
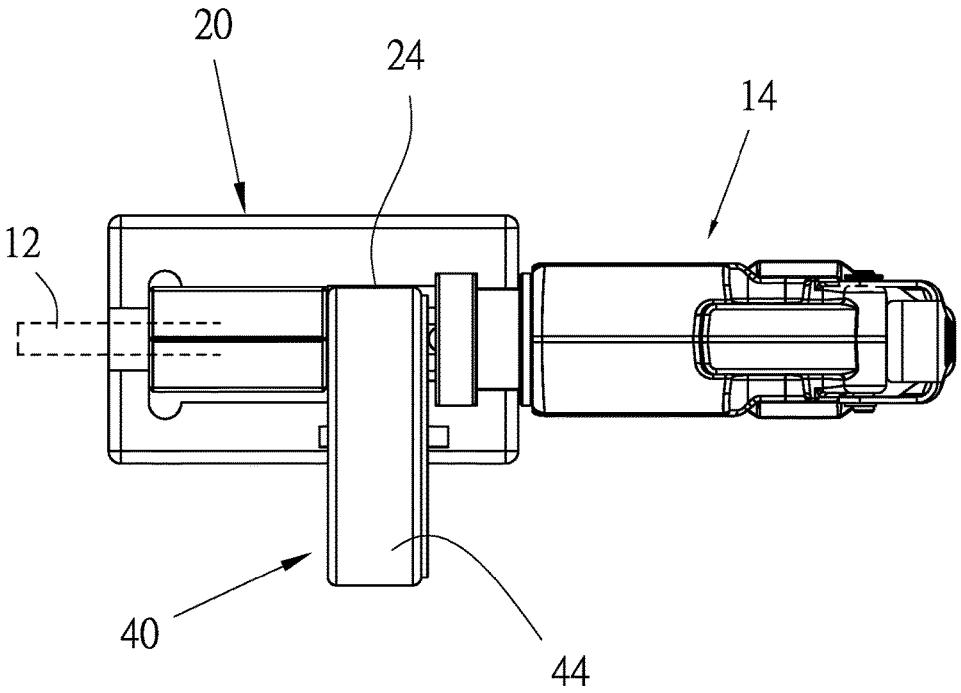
FIG. 13 is a top view of the third preferred embodiment of the present invention.

As shown in FIG. 3 and FIG. 13, a tube flaring tool of the third preferred embodiment of the present invention, which is similar to the first and the second preferred embodiments, except that a main member 44 of a punch assemble 40 is a disk mounted in a punch assembly slot 24 of a carrier 20 through an axle at a center of the disk. Therefore, the main member 44 is able to be rotated in the punch assembly slot 24 to select one of the punches 44 to flare the tube 12.

The solutions of moving, restricting and positioning a movement of the main member 44 of the punch assemble 40 of the second or the third preferred embodiments could be the same as the first preferred embodiment.

It must be pointed out that the embodiments described above are only some preferred embodiments of the present invention. All equivalent structures which employ the concepts disclosed in this specification and the appended claims should fall within the scope of the present invention.

What is claimed is:

1. A tube flaring tool, which is adapted to clamp a tube and align the tube with a punch driver, comprising:

a carrier having a clamping assembly slot and a punch assembly slot;

a clamping assembly received in the clamping assembly slot of the carrier to clamp the tube;

a punch assembly having a main member and a plurality of punches movably coupled to the main member, wherein the main member is movably received in the punch assembly slot;

wherein the main member of the punch assembly is moved to align the punches with the tube and the punch driver respectively;

wherein the main member of the punch assembly is a disk to be rotated.

2. The tube flaring tool of claim 1, wherein the main member of the punch assembly is an elongated member to be reciprocated in a straight path.

3. The tube flaring tool of claim 1, wherein the carrier is provided with a window, and a portion of the main member of the punch assembly is exposed through the window.

4. The tube flaring tool of claim 1, wherein the main member of the punch assembly is provided with a limiting slot, and the carrier is provided with a limiting member to engage the limiting slot.

5. The tube flaring tool of claim 1, wherein the main member of the punch assembly is provided with a plurality of positioning bores, and the carrier is provided with an elastic positioning member to engage one of the positioning bores.

6. The tube flaring tool of claim 5, wherein a surface of the main member of the punch assembly is aligned with the tube when the elastic positioning member engages one of the positioning bores for an end of the tube to abut against the surface of the main member.

7. The tube flaring tool of claim 1, wherein the main member of the punch assembly is provided with a plurality of punch bores, in each of which a spring and one of the punches are received, and the spring urges the punch inwards.

8. The tube flaring tool of claim 1, wherein the carrier is provided with a rotary slot, which connects to the punch assembly slot, and the punch driver includes a block to engage the rotary slot.

9. A tube flaring tool, which is adapted to clamp a tube and align the tube with a punch driver, comprising:

a carrier having a clamping assembly slot and a punch assembly slot;

a clamping assembly received in the clamping assembly slot of the carrier to clamp the tube;

a punch assembly having a main member and a plurality of punches movably coupled to the main member, wherein the main member is movably received in the punch assembly slot;

wherein the main member of the punch assembly is moved to align the punches with the tube and the punch driver respectively;

wherein the main member of the punch assembly is provided with a plurality of positioning bores, and the carrier is provided with an elastic positioning member to engage one of the positioning bores.

10. The tube flaring tool of claim 9, wherein a surface of the main member of the punch assembly is aligned with the tube when the elastic positioning member engages one of the positioning bores for an end of the tube to abut against the surface of the main member.

11. The tube flaring tool of claim 9, wherein the carrier is provided with a rotary slot, which connects to the punch assembly slot, and the punch driver includes a block to engage the rotary slot.

12. The tube flaring tool of claim 9, wherein the main member of the punch assembly is a curved member to be moved in a curved path.

13. A tube flaring tool, which is adapted to clamp a tube and align the tube with a punch driver, comprising:

a carrier having a clamping assembly slot and a punch assembly slot;

a clamping assembly received in the clamping assembly slot of the carrier to clamp the tube;

a punch assembly having a main member and a plurality of punches movably coupled to the main member, wherein the main member is movably received in the punch assembly slot;

wherein the main member of the punch assembly is moved to align the punches with the tube and the punch driver respectively;

wherein the carrier is provided with a rotary slot, which connects to the punch assembly slot, and the punch driver includes a block to engage the rotary slot.

14. The tube flaring tool of claim 13, wherein the main member of the punch assembly is a curved member to be moved in a curved path.

* * * * *